United States Patent [19]

Steinmann

[11] Patent Number: 4,709,962

[45] Date of Patent: Dec. 1, 1987

[54] WORK CHAIR WITH A TILTING MECHANISM FOR SEAT SQUAB AND BACKREST

[75] Inventor: Joachim Steinmann, Meersburg, Fed. Rep. of Germany

[73] Assignee: Kloeber GmbH & Co., Fed. Rep. of Germany

[21] Appl. No.: 790,933

[22] Filed: Oct. 24, 1985

[30] Foreign Application Priority Data

Oct. 24, 1984 [DE] Fed. Rep. of Germany ..... 3438901
Oct. 24, 1984 [DE] Fed. Rep. of Germany ..... 3438902

[51] Int. Cl.[4] ..... A47C 1/032

[52] U.S. Cl. ..... 297/301; 297/300; 297/304; 297/316; 297/320

[58] Field of Search ..... 297/300, 301, 304, 305, 297/316, 320, 321, 285

[56] References Cited

U.S. PATENT DOCUMENTS

| | | | |
|---|---|---|---|
| 2,365,200 | 12/1944 | Lorenz | 297/301 X |
| 2,507,601 | 10/1946 | Kehle . | |
| 3,989,297 | 11/1976 | Kerstholt | 297/300 |
| 4,200,332 | 4/1980 | Brauning | 297/300 |
| 4,451,085 | 5/1984 | Franck et al. | 297/300 X |
| 4,471,994 | 9/1984 | Zund et al. | 297/300 |
| 4,479,679 | 10/1984 | Fries et al. | 297/300 |
| 4,502,729 | 3/1985 | Locher | 297/300 X |
| 4,509,793 | 4/1985 | Wiesmann et al. | 297/300 X |
| 4,537,445 | 8/1985 | Neuhoff | 297/300 |

FOREIGN PATENT DOCUMENTS

| | | |
|---|---|---|
| 2223555 | 11/1973 | Fed. Rep. of Germany . |
| 2733322 | 8/1980 | Fed. Rep. of Germany . |
| G8401000 | 4/1984 | Fed. Rep. of Germany . |
| G8417429 | 9/1984 | Fed. Rep. of Germany . |

*Primary Examiner*—Kenneth J. Dorner
*Assistant Examiner*—Mark W. Binder
*Attorney, Agent, or Firm*—Hill, Van Santen, Steadman & Simpson

[57] ABSTRACT

The work chair has a seat squab and a backrest which both pivot on a seat carrier in the same direction interdependently. A load element is fitted to the seat carrier which is adjustable over its linear extension by means of a locking mechanism, whereby the load element pivots the seat squab and backrest into position of rest under spring loading.

To achieve a relatively large and symmetric spring loading in the smallest space it is foreseen that the load element should consist of two parallel compression springs in between which a hydraulic locking mechanism is fitted whereby one end of the load element is connected by a pivot to the free pivoting part of a lever arm, which forms the backrest-carrying part.

7 Claims, 7 Drawing Figures

WORK CHAIR WITH A TILTING MECHANISM FOR SEAT SQUAB AND BACKREST

BACKGROUND OF THE INVENTION

The invention concerns a work chair in accordance with the introductory description. A chair of this type is already known in the object of DE-AS No. 2,733,322. The aim of this known layout is to arrange a relatively strong load element in the smallest possible space in the area of the seat carrier with which it is possible to retain the backrest at a high spring loading in the position of rest in order to ensure the highest possible reverse loading when tilting the backrest and seat squab rearwards.

In the case of the known chair a coil compression spring is connected in parallel with a lockable gas spring strut. By alteration of the valve setting in the gas spring strut, the angle of the seat squab and back-rest carrier can be retained in any required position.

However, by the use of a gas spring strut it is not possible to achieve a high spring loading as such a gas spring strut has only about one third of the spring loading of the coil compression spring used. For technical reasons high spring loads from gas spring struts are not obtainable. Due to the connection of the coil compression spring referred to in parallel with the gas spring strut an asymmetric force is introduced on the seat squab and the backrest which can lead to an increased rate of wear on the bearing parts. In any case, the disadvantage exists in that by this parallel connection arrangement no high opposite force can be achieved in the required minimum space.

BRIEF SUMMARY OF THE INVENTION

The invention therefore takes as its basis the further development of such a chair as mentioned in the introduction in such a way that in the same space requirement a sustantially higher spring force can be achieved.

To achieve this object the invention is therefore characterized in that the load element consists of two parallel compression springs in between which a hydraulic locking element is fitted and that one end of the load element is attached by a pivot to the free pivoting part of a lever arm, which forms the backrest-carrying part.

A feature of the invention is then, that a symmetrical introduction of force is achieved by the use of two parallel compression springs and that, instead of the usual gas spring strut, a known hydraulic locking element is used. A hydraulic locking element of this type is known, for example, by the objects of U.S. Pat. No. 2,507,601 or DE-OS No. 2,223,555. In the present invention protection is sought only for the use of such a hydraulic locking element in connection with the other described elements.

Specifically then, when one connects the hydraulic locking element between the two parallel compression springs, an absolutely symmetric load is introduced on the rake-adjustable seat and the synchronized rake-adjustable backrest carrier in such a way that the stresses on the mounting are less, thus reducing the wear rate. However, by the parallel connection of two compression springs a substantially higher force can be achieved than in the case of the known work chairs, in that in those cases merely one compression spring was connected in parallel with a relatively weak gas spring strut.

In the case of the load system described in the introduction it is particularly preferred, when the seat squab is connected by a pivot about a first axle nearest its front edge with the seat carrier and when the backrest carrier is connected with the seat carrier by a part at its front end about a second axle, and when the seat squab is connected to the backrest carrier at a distance from its front bearing point by a pivot about a third axle which has radial play and is nearest to its front edge.

With this special tilting mechanism fundamental advantages over the known arrangements are achieved in that the known arrangements require the use of several separate intermediate levers between the backrest carrier and the seat carrier to achieve synchronized inclination of both seat squab and backrest carrier.

In the case of the previously quoted DE-AS No. 2,733,322 a multiple-bend elbow-lever system is used, and in the case of DE-GM No. 8,417,429 an intermediate lever, pivoted at both ends, is used which has one more bearing point than the arrangement according to the invention which leads to higher manufacturing costs and a greater wear rate.

The tilt mechanism as presently described excels in that the backrest carrier is connected directly and in one piece to a lever arm whose free, and pivoting end projects into the seat carrier and functions there as a point of force application for the above mentioned load element. Through the one-piece form of the backrest carrier and its attached lever arm, the previously described intermediate lever is avoided and the complete system is simpler and more economic. A pre-condition for this style of mounting is, however, that the seat squab is connected, at its rear side, to the backrest carrier by a pivot about a third axle having radial play.

A particularly simple arrangement of the load element then arises when the load element acts on the first axle at one end and the other end is mounted on a shaft in the area of the lever arm of the backrest carrier. During pivoting of the backrest carrier the lever arm moves about the second axle as a fulcrum and the load element is then compressed to a greater or lesser degree.

It goes without saying that here the load element is always to be understood as consisting of the parallel connection of a minimum of two compression springs together with a hydraulic locking element connected between them.

By mounting the load element as previously described, a relatively high spring loading is achieved in a minimum of space.

If a greater force is required in the same space with the same load element of the same dimensions, it is preferred that the load element bears on a bearing bolt which is mounted on the seat squab itself at a distance from the first axle of the seat squab and that the other end is mounted in a shaft in the area of the lever arm of the backrest carrier.

In this fashion the load element is compressed from two sides when the seat squab and the backrest carrier move in a synchronized fashion from their position of rest into a raked rear position.

On the one hand here, the upper end of the load element pivots in the direction of the longitudinal axis of the load element during rearward tilting of the backrest carrier and on the other hand, the other end of the load element simultaneously moves in an opposing way also in the direction of the longitudinal axis of the load element, thus compressing the load element from both sides. In this fashion and for the same given dimensions of the load element and its assembly relationship, a greater range of movement of the spring is achieved leading to a higher spring force of the load element.

In a further development of the present invention it is provided for that the force of the load element is adjustable in that the end of the load element nearest to the shaft is arranged in an axle in the free pivoting part of a weight adjustment lever, which is itself pivot-mounted in the shaft on the lever arm of the backrest carrier, whereby the swivelling of this weight-adjustment lever is adjustable by means of a hand-operated worm drive.

One end of the load element then no longer acts directly on the lever arm of the backrest carrier, rather only indirectly through a weight adjustment lever which is itself pivotable by a hand-operated worm drive. In this fashion the spring loading of the load element can be pre-adjusted to compensate for the weight of the user who leans against the backrest carrier with his body weight.

In the following a further essential feature of the present invention will be described in connection with a so-called over-dead-centre arrangement.

In the case of the previously known arrangements of the current state of the art having a tilt mechanism the disadvantage existed in that, in the vertical sitting position of the backrest carrier only a relatively light pressure against the back of the user is achieved by the load system mentioned. If the user leans only lightly against the vertically positioned backrest carrier in the case of the known work chairs, this relatively small force is enough to tilt the backrest carrier from its vertical position to a raked position whereby the seat squab carries out a synchronized tilting (with a different rake however).

In particular fields of operation (especially for clerical staff) it is a requirement however, that the backrest carrier does not yield to a light pressure of the back thus tilting to its rearward position. Up to now one has had to assist, in that the position of rest of the backrest carrier a hand-operated mechanical lock was provided which had to be continually unlocked by hand to pivot the backrest carrier to its tilted position. Here the invention steps in, in that an automatic unlocking of the vertical position of the backrest carrier is ensured.

This automatic freeing-off is always achieved when the user presses his back with considerable force against the backrest whereby the previously mentioned over-dead-centre point arrangement must be overcome. This over-dead-centre point functions only over a range of about 10% of the total range of pivoting movement, the previously described load system acting over the remaining 90%. The over-dead-centre arrangement fundamentally consists of a slightly folded pair of elbow-levers which can be folded against the force of a compression spring. In the vertical position of the backrest carrier this elbow-lever pair is only slightly folded and it requires, therefore, a relatively large force on the backrest carrier to bring the elbow-lever pair into the folded position (non-acting) against the force of the coil spring. If however, the elbow-lever pair is once folded, it brings only a minimal resistance to bear against a further rake adjustment of the backrest carrier.

The subject matter of the present invention arises not only from the subject matter of the single Patent Claims but also from the combination of the single Claims one with each other.

All the details and features published in the documents, particularly the construction details shown in the drawings are claimed as being essential for the invention in so far as they are either singly or in combination new in comparison to the current state of the art.

In the following the invention is further explained using drawings illustrating several methods of implementation. Further advantages and features essential to the invention arise from the drawings and their accompanying descriptions.

Figure 1:
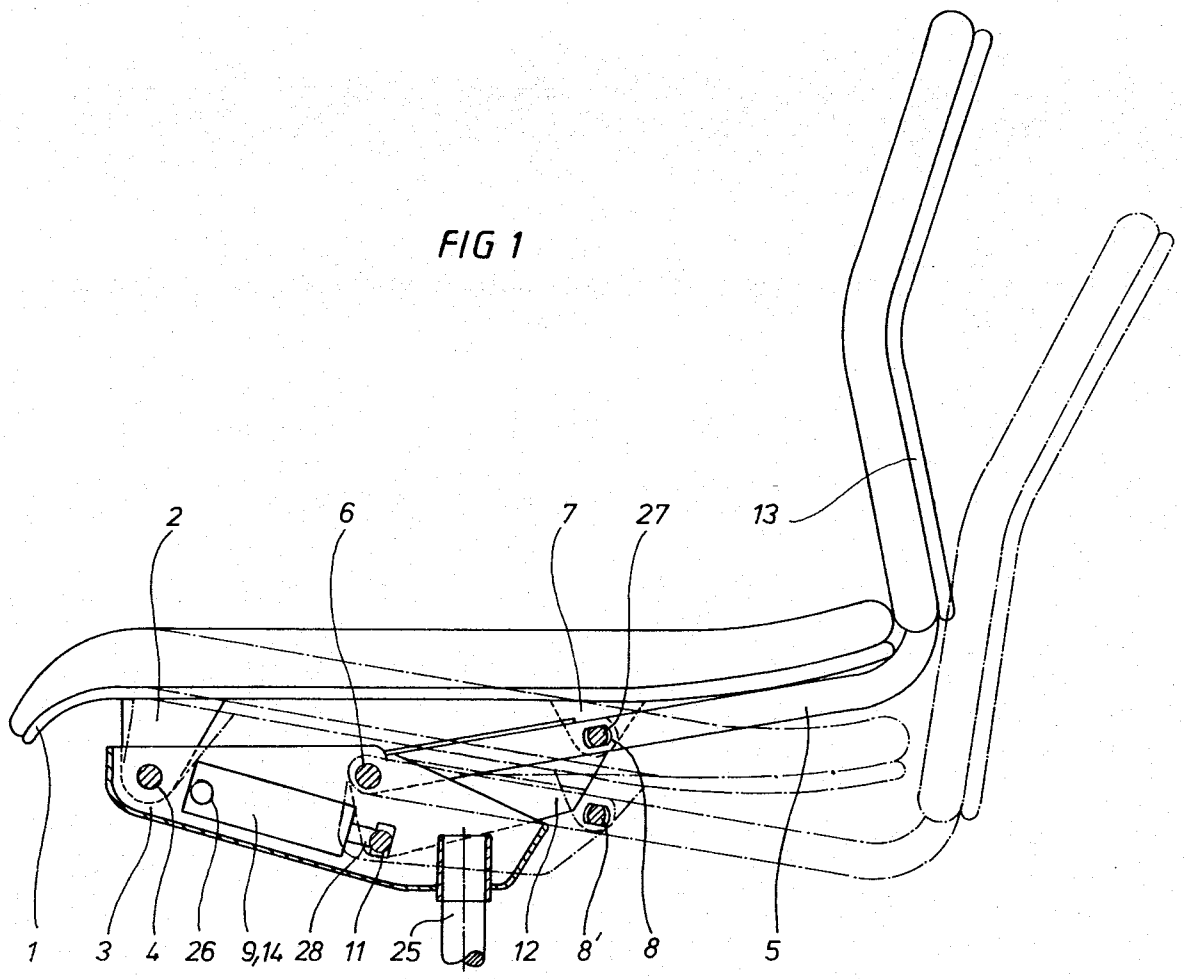
FIG. 1 is a schematic side view of a first embodiment of a work chair according to the present invention.
Figure 2:
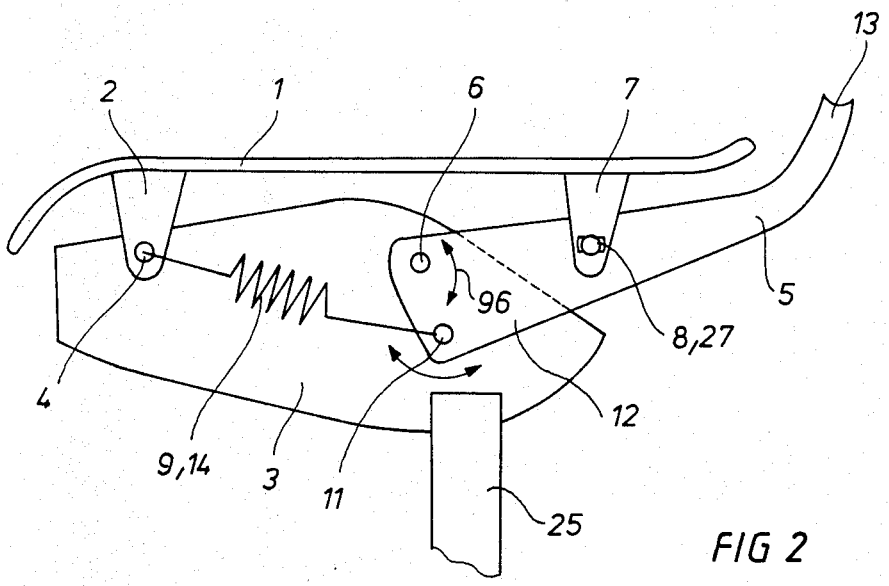
FIG. 2 is a partial schematic side view of the work chair of FIG. 1.
Figure 7:
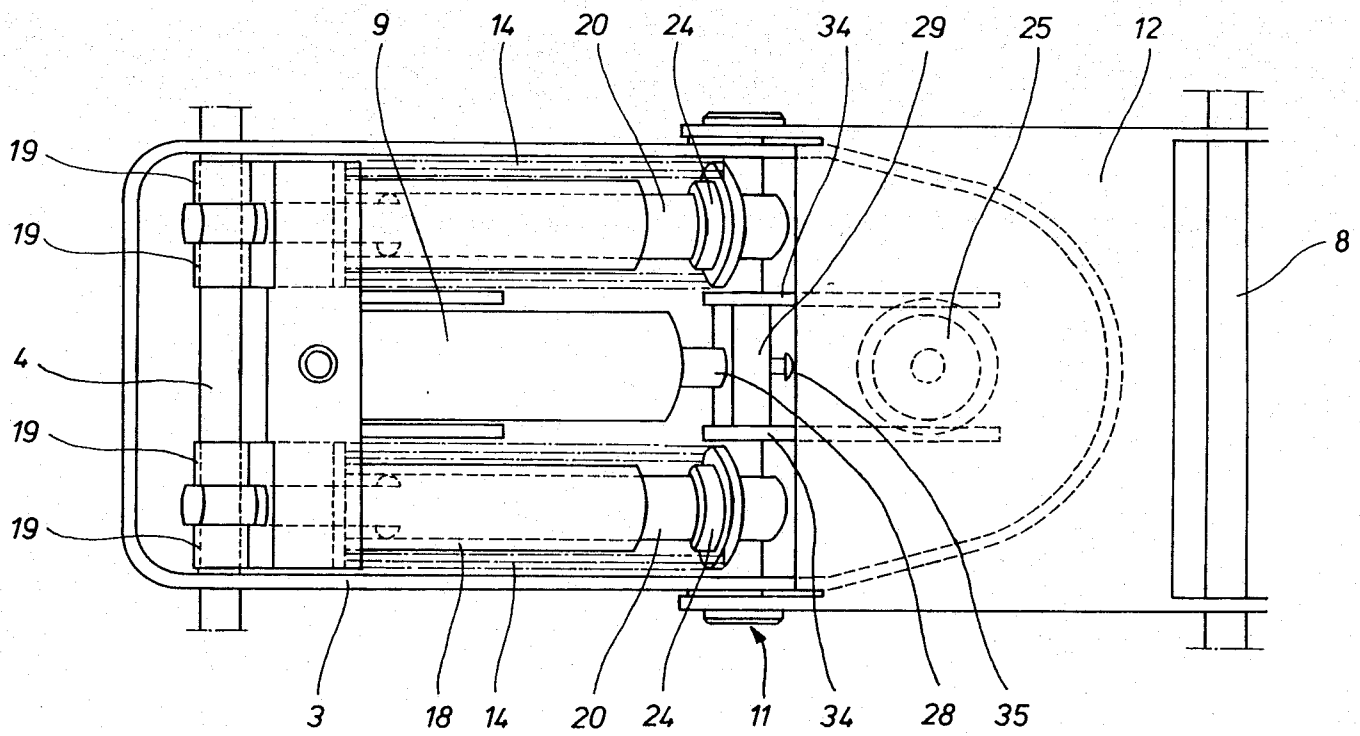
FIG. 7 is a top plan view with portions removed for purposes of illustration of the chair of FIGS. 1 and 2.

DETAILED DESCRIPTION:

The seat squab (1) of the work chair shown in FIGS. 1, 2 and 7 is pivotally connected to the carrier (3) by bearing eyes or pads (2) being received on a first axle (4). The backrest carrier (5) which carries the backrest (13) is likewise pivotally mounted on seat carrier (3) by means of a second axle (6). Additionally the backrest carrier (5) is pivotally connected to seat squab (1) by a bearing eye (7) and a third axle (8). The eye or pad 7 has a slotted hole (27) so that the third axle 8 has radial play.

A hydraulic locking element (9) is pivoted on the first axle (4) (compare FIG. 1 and FIG. 7). The piston rod (28) of this locking element (9) is pivot jointed by its bearing eye through a shaft (11) to a lever arm (12). This lever arm (12) is a part of the backrest carrier (5).

From this layout arise the interdependent and differing angular movements of the seat squab (1) and the backrest (13), as shown by the dotted lines in FIG. 1. The ratio of movement is dependent on the spacing of the bearing points (4) (6) and (8). This results in a ratio of movement between the seat squab (1) and backrest (13) of 1:2, that is, when the seat squab (1) tilts downwards through an angle of 10°, the backrest (13) tilts some 20° to the rear.

Due to the described positioning of the axles (4) (6) and (8) there arises, during tilting back, a downwards movement of the backrest (13) relative to the seat squab (1). This ratio is however, so selected, that during rearwards tilting of backrest carrier (5) and seat squab (1) there is no relative movement between the back of the user and the backrest (13). This prevents the users clothing from becoming bunched up which could otherwise lead to discomfort.

It is to be seen from FIG. 1 in connection with FIG. 7 how the mentioned load system is arranged. It consists, in the illustrated embodiment example, of two parallel mounted compression springs (14) (Ref. FIG. 7) in between which is connected a hydraulic locking element (9). The return force which acts against the body weight of the user distributed between the seat squab (1) and the backrest (13) is caused by these two compression springs (14) situated either side of the hydraulic locking element (9). Each compression spring (14) is supported on a roller (19) as shown in FIG. 7 which are pivoted on the front axle (4). Also according to FIG. 7 the hydraulic locking element (9) engages with the first axle (4), the valve stem (35) of the hydraulic locking element is operable by a non-illustrated lever, so that the displacement of the two parallel compression springs (14) is lockable in any desired intermediate position. In this fashion any desired position of the seat squab and back rest can be fixed.

The piston rod (28) of the hydraulic locking element (9) goes through a corresponding hole in the base plate (29) (Ref. FIG. 7) and is secured about its external threaded portion by a threaded nut which rests on the outside of the base plate (29). On the opposite side relative to the nut rests the valve stem (35) which is operable by a non-illustrated lever. The heads of the compression springs (14) shown as spring guides (24) are mounted through specific holes in corresponding bearing bushes, which are retained, rotatable, by corresponding legs (34). The legs extend, according to FIG. 7, into the area of the middle pillar (25) and are connected to it there. The guide rod (20) of each compression spring (14) is seated, with its spring guide (24) on the external side of a bearing bush and its collar of reduced cross-section penetrates through this bearing bush in the area of each hole respectively. The described construction has the advantage in that it can be easily disassembled as the bearing bolts for the shaft (11) which are accesible from the outer sides of the seat carrier (3) can be simply screwed out in an axial direction, thus enabling the locking element (9) together with the base plate (29) to be removed.

As above mentioned, the hydraulic locking element (9) is directly attached to a shaft (26) which is firmly secured in the seat carrier (3).

To clarify the pattern of movement of the first embodiment previously described by means of FIGS. 1 and 7, reference should now be made to the schematic illustrations in FIG. 2.

Here it will be evident that the backrest (13) with its backrest carrier (5) is mounted on the second axle (6) in the seat carrier (3) so as to pivot in the direction of arrow (96). As the seat squab (1) is attached by its bearing eye (7) to the free, pivoting part of the backrest carrier (5) in the third axle (8), the seat squab (1) thus tilts downwards in synchronized fashion.

As the lever arm (12) is a direct part of the backrest carrier (5) the shaft (11) also pivots in a clockwise direction an the area of the lever arm (12) about the fulcrum of the second axle (6) when the backrest (5) tilts downwards.

As the load system according to the first described embodiment example is attached on one side to the shaft (11) and on the other side to a locally escured shaft, e.g. the first axle (4), it will be recognised that the load system (9) (14) exerts a specific opposite force during rearwards swivelling of the backrest carrier (5).

A second embodiment example of the work chair according to the invention will now be described by means of the drawings FIGS. 3 and 6, which distinguishes itself in that a substantial increase in spring force can be achieved in the same space requirement of the load system.

For explanation of this, reference to FIG. 3 will be made, where the same parts that are identical with the first embodiment example carry the same reference numbers.

In contrast to the firstly described embodiment example according to FIG. 2, the upper end of load system (9) (78) does not act directly on a fixed point in the seat carrier (3) but is pivotally mounted by a bearing bolt (84) in bearing eye (2) of the seat squab (1).

As the bearing bolt (84) is at a distance (31) from the first axle (4), the bearing bolt (84) pivots in the direction of the arrow about the fulcrum of the first axle (4) when the seat squab (1) and backrest carrier (5) are tilted rearwards. In this way this end of the load elements (9) (78) is compressed, during which action the opposite end of the load elements (9) (78) are likewise compressed in an opposing fashion. Reference is made here to the illustration in FIG. 2 which shows that it is sufficient to pivotally mount this end of the load element in the lever arm (12) of the backrest carrier (5).

Figure 3:
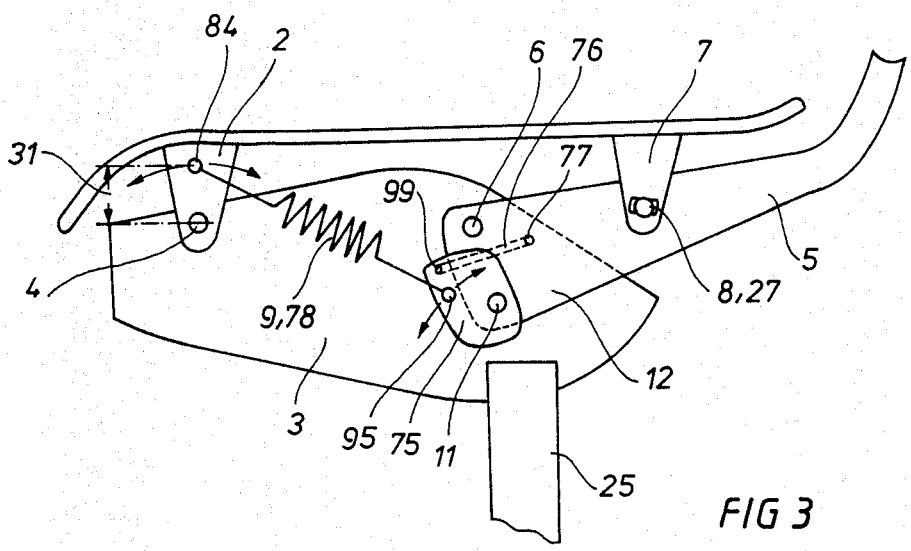
FIG. 3 is a partial schematic side view of a second embodiment of the work chair of the present invention.

FIG. 3 shows however, yet a further adjustment for the regulation of the spring force of the load elements (9) (78).

This end of the load element is not directly mounted in shaft (11) but in the free pivoting part of a weight adjustment lever (75) which is itself pivotally mounted on shaft (11). The rotation of the weight adjustment lever (75) in the direction of the arrow about the fulcrum of shaft (11) is achieved by a hand-operated worm drive (76) one end of which acts on an axle (99) in the free pivotable part of the weight adjustment lever (75), the other end being secured on an attachment point (77) on lever arm (12).

Figure 4:
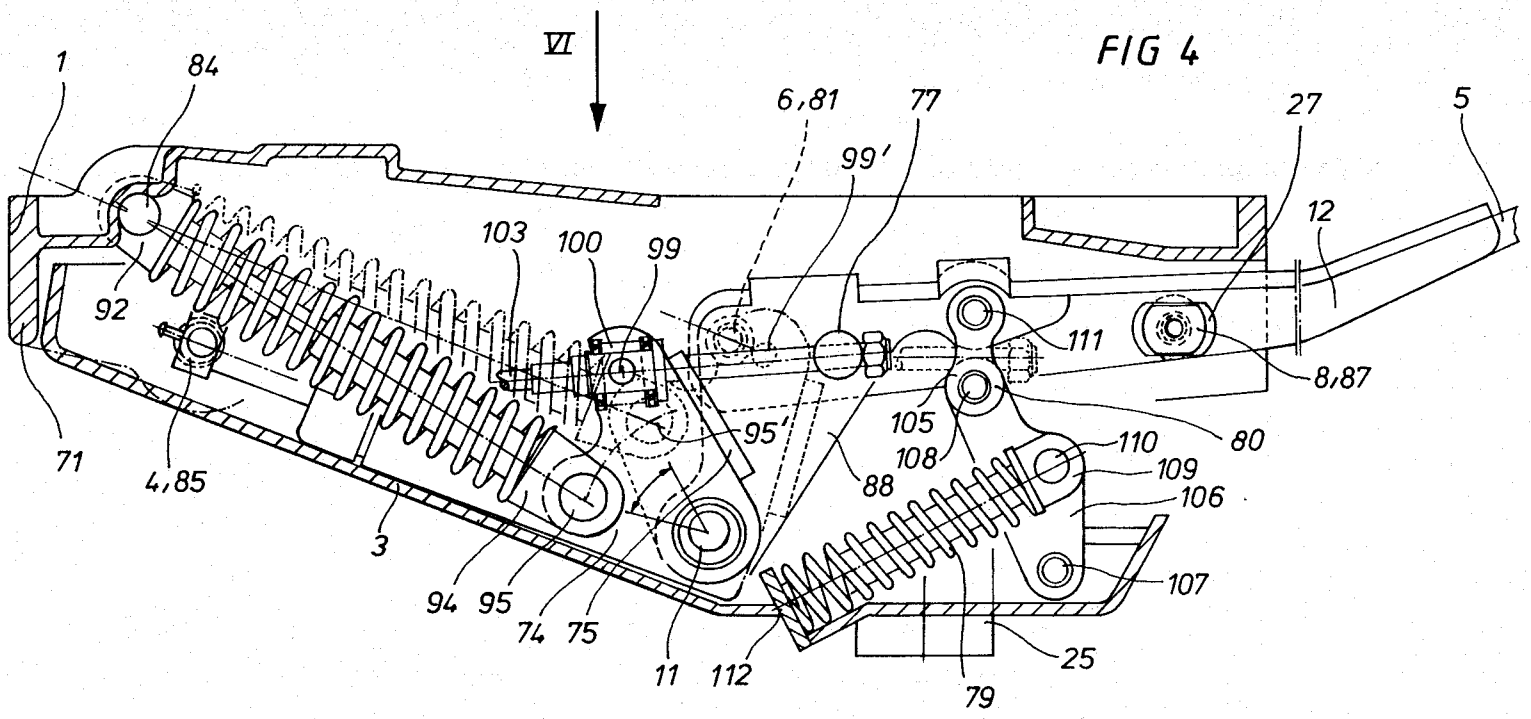
FIG. 4 is a cross-sectional view with portions in elevation of the chair of FIG. 3 taken along lines IV—IV of FIG. 6.
Figure 5:
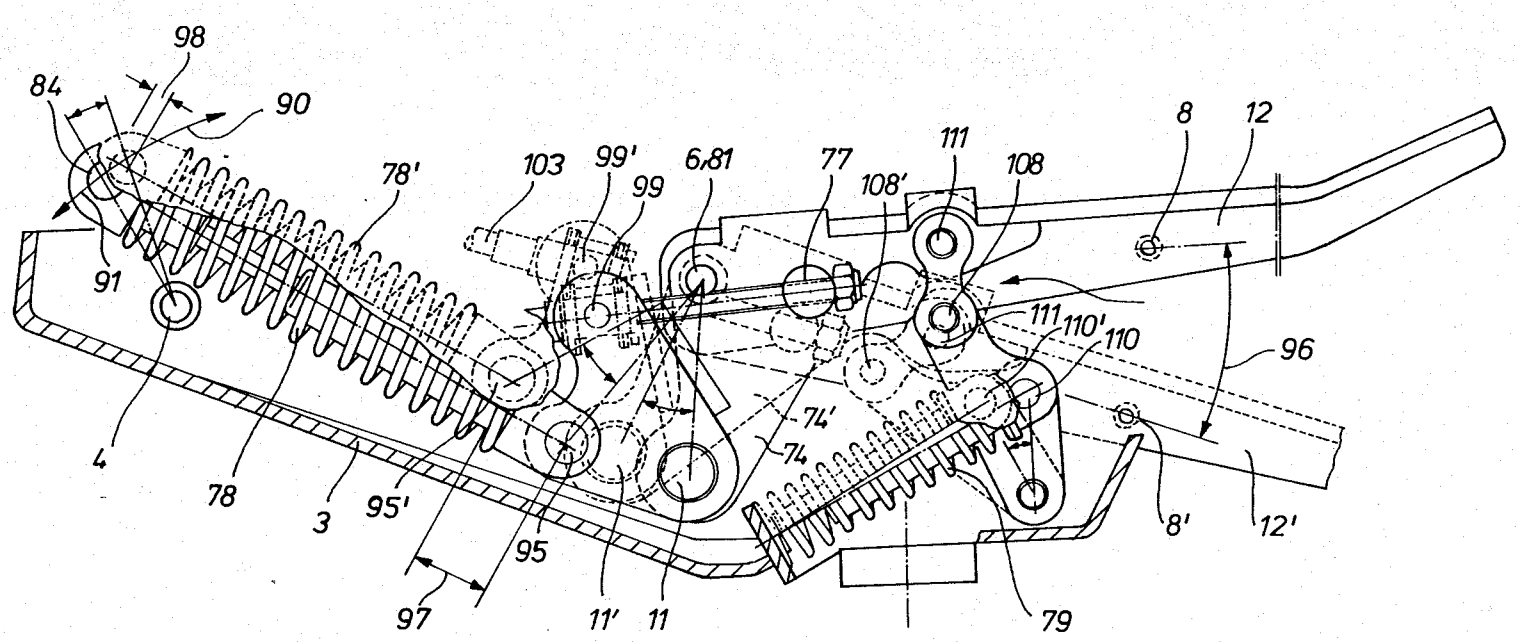
FIG. 5 is a cross-sectional view with parts removed for purposes of illustration similar to FIG. 4 showing a backrest carrier in both a raked position and a vertical position.
Figure 6:
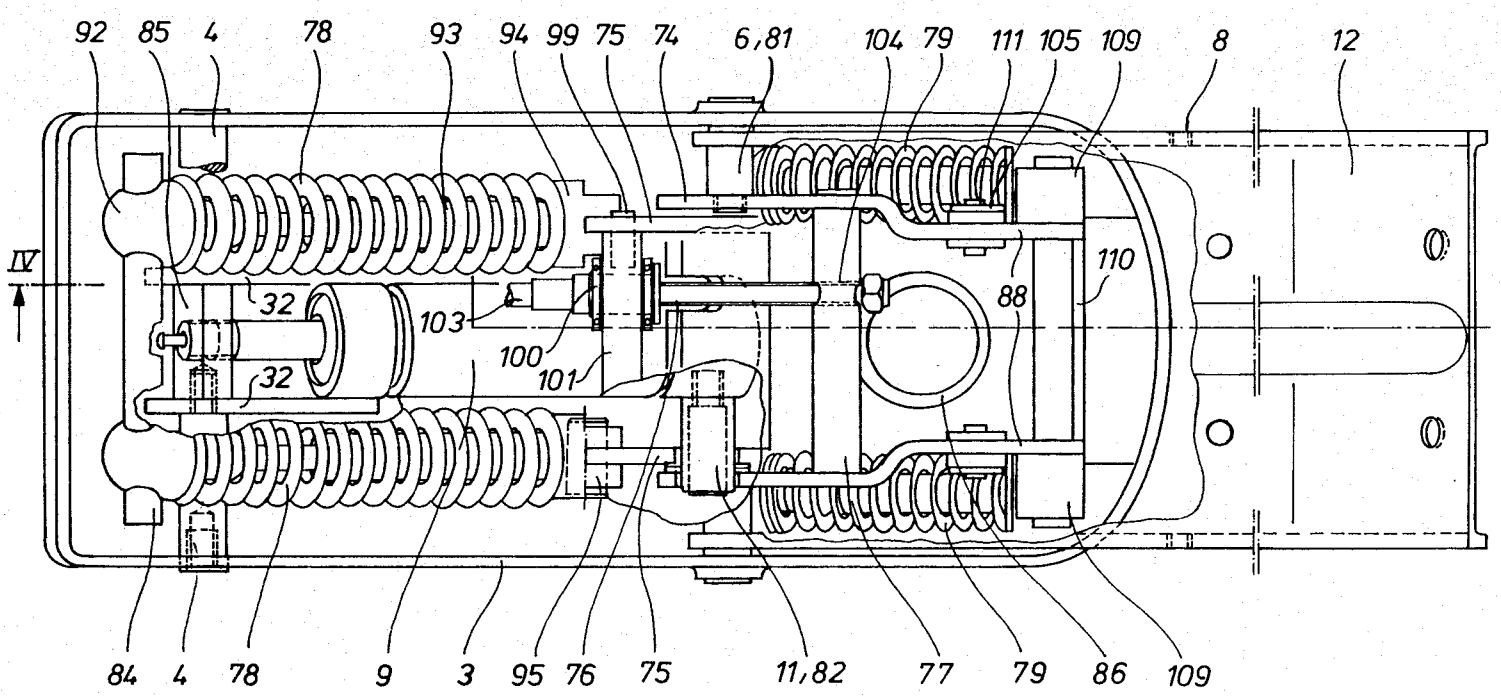
FIG. 6 is a plan view with portions broken away for purposes of illustration taken in the direction of arrow VI of FIG. 4.

A constructional embodiment example of the fundamental parts of the movement mechanism of the work chair will now be further explained using the schematic illustrations in FIGS. 4 to 6.

Therein, a further position of the referenced parts is shown by means of references indicated by an elevated line.

Two parallel mounted compression springs are fitted in the seat carrier (3) which are indicated as operating springs (78). The upper position of operating springs (78) is formed by a bearing bolt (84) which is pivot mounted in seat squab (1) and which has a specific pivoting action in the direction of arrows (90) (91) about axle (4) when the backrest carrier (5) and seat squab (1) are tilted into their rearwards-raked position.

Both operating springs (78) have a spring head (92) through which is fitted the bearing bolt (84). The operating springs are mounted on a telescopic spring guide (93) whereby the other end of each operating spring (78) also rests on a spring head (94) which acts on the free pivoting part of the weight adjustment lever (75). The point of application is formed by the axle (95) whereby the weight adjustment lever (75), formed as a U-shaped profiled part (Ref. FIG. 6) is pivotally mounted on the axle (6) in the lever arm (12).

The lever arm (12) formes an internal bearing (74) in conjunction with two spaced traverse arms (88). This internal bearing accepts the shaft (11) to thus form the pivot point for the weight adjustment lever (75).

It is to be seen from FIG. 5 that when the lever arm (12) is pivoted from its upright position to its lowered position in the direction of arrow (96) then the upper third axle (8) pivots simultaneously into position (8'), the shaft (11) pivots simultaneously into position (11') and the axle (95) as bearing point for the respective operating springs (78) pivots into it position (95').

From this it will be seen that the operating springs (78) are compressed twice, that is firstly by the movement of axle (95) into its forward position about the displacement range (97), and secondly in that the upper bearing end of the respective operating springs (78) is compressed through the displacement range (98). By means of this special arrangement then, the force of the springs is used twice, or vice versa, a specific adjusment movement through a specific angle creates a greater range of compression of the spring. Thereby it is possible with this invention to create relatively high spring forces although springs requiring minimal space may be used.

In the following the arrangement for the adjustment of spring forces already mentioned will be described.

This arrangement consists of the weight adjustment lever (75) on whose upper, free pivotable end, in the area of axle (99), a ball bearing (100) is fitted, on which is carried the axial loads acting on the longitudinal axes of the worm drive (76).

The axle (99) is pivotally mounted in the free, pivoting part of the weight adjustment lever and is fruther connected to a traverse arm (101) which connects one end of the U-shaped weight adjustment lever (75) with the other end through a similar axle (99).

The attachment of a flexible shaft (103) is only shown in outline in FIGS. 4 to 6, which is torsionally connected to the worm drive (76) and which engages the other part of the worm drive by means of its male thread and a corresponding female thread (104) which is cut into attachment point (77).

This attachment point (77) is rotatably mounted in the internal bearing (74) i.e. it is rotatably mounted between spaced traverse arms (88).

By rotation of the flexible shaft (103), which ends in a hand operated wheel, external to the seat carrier, the length of the worm drive (76) is altered, thus moving the bearing (100) to a greater or lesser degree to or from the female thread (104). An adjustable movement of this type is, for example, illustrated in FIG. 4 where it is to be seen that the axle (99) is displaced into axle (99') by adjustment of the worm drive (76).

FIG. 5 shows, by means of a dotted line, that by tilting the backrest carrier (12) the complete worm drive (76) in connection with the ball bearing (100) is pivoted in to the position indicated by the dotted line. Similarly indicated by dottod lines in FIG. 5 are the other parts which experience a change in position when the backrest carrier (12) is tilted in the direction of arrow (96).

FIG. 4 shows the seat squab is formed by a bearing housing (71) which overlaps the seat carrier (3) from above. It is to be seen further from FIG. 4 that the second axle (6) is formed from opposing trunnions (81) fitted in seat carrier (3).

The hydraulic locking element is also mounted in a trunnion (82) (Ref. FIG. 6) on the shaft (11) which is the trunnion (81), whereby the trunnions (81)(82) respectively, act on the traverse arm (88).

The front end of the locking element (Ref. FIG. 6) is mounted in a pivot block (85) which is connected to the bearing bolts (4) by the longitudinal traverse arms (32).

FIG. 4 shows that the third axle (8) is mounted in a pivot block (87) in the area of the slotted hole (27) in backrest carrier (5).

FIG. 6 also shows that the central pillar (25) passes through the seat carrier (3) forming at that point a conical tube (86) to support the lift spring.

In the following, the function of an over-dead-centre arrangement is explained, which allows that when the backrest carrier is upright the force of the operating springs (78) is re-inforced by this over-dead-centre arrangement in the sense that in the upright position of the backrest carrier (12) a specific force acts against the body of the user when he leans against this backrest carrier.

This mentioned stabilization of the upright position of the backrest carrier is, naturally, only valid when the operating springs are not locked by the locking element (9) or when the hydraulic locking element is replaced by a corresponding mechanical locking.

If this locking is released then the over-dead-centre point arrangement, described in the following, serves to stabilize the upright position of the lever arm (12) in conjunction with the connected backrest carrier (5) and backrest (13).

The over-dead-centre arrangement consists of an elbow joint (80) which is formed from two elbow levers (105) (106) connected by an articulated joint.

The upper elbow lever (105) is pivotally mounted in a bearing bolt (111) on the internal bearing (74) in the area of the mutually opposing traverse arms (88) which is to be seen from the plan view in FIG. 6.

The other end of the elbow lever (105) is connected to the second, larger elbow lever (106) by bearing bolt (108) the other end of which lever (106) is pivotally mounted on the seat carrier (3) by bearing bolt (107).

FIG. 5 shows how the bearing points vary themselves when the backrest carrier (5) is tilted from its highest position into its rearwards raked position.

The elbow joint (80) then folds in a forwards direction towards the front edge of the seat, whereby the free pivoting bearing bolt (108) assumes position (108') and the lower elbow lever (106) rotates simultaneaously in an anti-clockwise direction about the lower, fixed bearing bolt (107).

The point of application of the spring with the bearing bolt (110) also moves into the position (110') in the direction of the front edge of the chair thus compressing the spring (79). The other end of spring (79) sits on a support (112) in the seat carrier (3).

It can be seen, then, from FIGS. 4 to 5 that the tilting from the upright sitting position to the raked sitting position only takes place when the elbow joint (80) is displaced against the pressure of the spring (79) whose spring head (109) is mounted in bearing bolt (110).

According to FIG. 6 it can be seen that a total of two parallel mounted springs (79) exist which act in parallel on bearing bolt (110).

It therefore concerns an over-dead-centre point because in the upright sitting position in accordance with FIG. 4, both elbow levers (105) (106) assume a relatively outstretched position whereby it is relatively difficult to deflect these two elbow levers out of their outstretched position against the pressure of spring (79). A relatively minimal spring (79) force is therefore sufficient to hinder such a deflection.

That means then, that in the first transition region from the upright sitting position into the raked sitting position, the elbow joint acts with a great force against this tilting force and with increasing range of tilt of the backrest and backrest carrier (5) this opposing force becomes smaller, and is at its minimum in the dotted position shown in FIG. 5, from which arises that the operating spring (78) exert the greatest measure of opposing force on the backrest.

Drawing Legend

1. Seat squab
2. bearing eye
3. Seat carrier
4. axle (first)
5. backrest carrier
6. axle (second)
7. bearing eye
8. axle (third) 8'axle
9. hydraulic locking element
11. shaft 11'shaft
12. lever arm
13. backrest
14. compression spring
19. roller
20. guide rod
24. spring guide
25. central pillar
26. shaft
27. slotted hole
28. piston rod
29. base plate
31. spacing (between 4 and 84)
32. longitudinal traverse arm
34. leg
35. valve stem
71. bearing housing
74. internal bearing
75. weight adjustment lever
76. worm drive
77. attachment point (worm drive)
78. operating springs
79. compression springs
80. elbow joint
81. trunnion
82. trunnion-hydraulic locking element
84. bearing bolt (operating springs)
85. pivot block-locking element
86. conical tube, lift spring support
87. pivot block
88. traverse arm
90. arrow direction
91. arrow direction
92. spring head
93. spring guide
94. spring head
95. axle
96. arrow direction
97. displacement range
98. displacement range
99. axle
100. ball bearing
101. traverse arm
103. flexible shaft
104. nut thread
105. elbow lever
106. elbow lever
107. bearing bolt
108. bearing bolt
109. spring head
110. bearing bolt
111. bearing bolt
112. support

What we claim is:

1. A work chair having a seat carrier, a seat squab having a front edge and a rear edge, a backrest carrier with a backrest and a lever arm extending from said backrest, a first pivotal connection being formed by a first axle adjacent the front edge for securing the seat squab to the seat carrier, a second pivotal connection being formed by a second axle securing a free end of the lever arm of the backrest carrier to the seat carrier, a third pivotal connection between the seat squab and backrest carrier, said third pivotal connection being formed by a third axle connecting said lever arm inward of the free end thereof to the rear edge of said seat squab with a loose connection having play so that the seat squab and backrest will pivot interdependently in the same direction, load element means for pivoting the seat squab and the backrest carrier into a position of rest under spring loading, said load element means comprising two parallel extending compression springs with a hydraulic locking element means disposed therebetween for adjusting the linear extension of each of said two springs, one end of the load element means being pivotally connected to a free end of the lever arm of the backrest carrier and the other end of the load element means being connected to the squab seat adjacent the first pivotal connection.

2. A work chair according to claim 1, wherein the one end of the load element means is connected to the lever arm of the backrest carrier by a shaft, the other end of the load element means being connected to the first axle.

3. A work chair according to claim 1, wherein the one end of the load element means is connected to the free end of the lever arm by a shaft and the other end is connected by a bearing bolt which is secured to the seat squab at a distance from said first axle.

4. A work chair according to claim 3, wherein the locking element means has one end connected to an axle of a free pivot part of a weight adjustment lever, said weight adjustment lever being pivotally mounted on said shaft and the chair includes a hand operated worm drive for adjusting the pivoting of the weight adjustment lever relative to the free end of the lever arm of the backrest.

5. A work chair according to claim 1, wherein the chair includes over-dead-center arrangement means for increasing resistance to the commencement of the tilting action of the seat squab and backrest carrier from the position of rest towards a rake position for the backrest carrier, said over-dead-center means extending between the seat carrier and the backrest carrier and coacting with the load element means.

6. A work chair according to claim 5, wherein the over-dead-center arrangement means consists of a pair of elbow levers interconnected by a bearing bolt, a first lever of said pair of levers being connected by a bearing bolt to the backrest carrier and a second lever of said pair being connected to t he seat carrier by a bearing bolt, a compression spring having one end supported on the seat carrier and the other end acting on the second lever of said pair.

7. A work chair according to claim 6, wherein the over-dead-center arrangement means includes two pairs of levers and two compression springs.

* * * * *